US010107481B1

(12) United States Patent
Chen

(10) Patent No.: US 10,107,481 B1
(45) Date of Patent: Oct. 23, 2018

(54) LAMP SUPPORT STABILIZER

(71) Applicant: Sikai Chen, Delran, NJ (US)

(72) Inventor: Sikai Chen, Delran, NJ (US)

( * ) Notice: Subject to any disclaimer, the term of this patent is extended or adjusted under 35 U.S.C. 154(b) by 0 days.

(21) Appl. No.: 15/967,786

(22) Filed: May 1, 2018

(51) Int. Cl.

| | |
|---|---|
| ***F21V 17/06*** | (2006.01) |
| ***F21V 17/10*** | (2006.01) |
| ***F21V 23/06*** | (2006.01) |
| ***F21Y 115/10*** | (2016.01) |

(52) U.S. Cl.
CPC ..... *F21V 17/06* (2013.01); *F21V 17/10* (2013.01); *F21V 23/06* (2013.01); *F21Y 2115/10* (2016.08)

(58) Field of Classification Search
CPC ..... F21V 17/06; F21V 17/10; F21V 23/06; F21Y 2115/10
See application file for complete search history.

(56) References Cited

U.S. PATENT DOCUMENTS 4,803,396 A * 2/1989 Kelner ..... F21V 17/06 313/318.01
2003/0223235 A1* 12/2003 Mohacsi ..... F21S 2/00 362/240

* cited by examiner

*Primary Examiner* — Mary Ellen Bowman
(74) *Attorney, Agent, or Firm* — Stuart M. Goldstein

(57) ABSTRACT

A lamp support stabilizer has an integral, unitary body having a plate shaped base member with dual lateral tension clips extending down from the base member. An adhesive member is attached to the bottom surface of the base member. A columnar support member having an internal channel extends up from the top surface of the base member. The adhesive member with the stabilizer attached is configured to be positioned on the electrical socket, with the tension clips tightly hugging the sides of the socket. The lamp support on which LED lights are mounted is positioned within the channel located in the columnar support.

7 Claims, 6 Drawing Sheets

LAMP SUPPORT STABILIZER

BACKGROUND OF THE INVENTION

Light emitting diodes (LED) are commonly used for signage on stores, restaurants, bars, billboards, and other structures where there is a need to display information, to provide safety lighting, or to identify or accentuate the appearance of a building. Such LEDs are routinely mounted on lamp supports which specifically direct the lighting to illuminate signage. However, natural environmental conditions such as high winds, storms, earthquakes and tremors, and man made events such as impacts and damage to signage or sign supports resulting from vehicle collisions, can result in total displacement of LED lighting or unwanted light angle tilt. Light angle tilt is the correct position a light beam is directed to optimally illuminate the face of a sign, Displacement of the light angle tilt could result in the sign being partially hidden or not seen at all.

SUMMARY OF THE INVENTION

It is thus the object of the present invention to provide a lamp support stabilizer which is fitted on an LED lighting lamp support in order to prevent displacement of the lamp support and hence the LED lighting, or to prevent a tilt in the lighting angle.

These and other objects are accomplished by the present invention, a lamp support stabilizer which uses a "stick and hug" method to lock itself to the face of an existing electrical HO socket. The stabilizer comprises an integral, unitary body having a plate shaped base member with dual lateral tension clips extending down from the base member. An adhesive member is attached to the bottom surface of the base member. A columnar support member having an internal channel extends up from the top surface of the base member. The adhesive member with the stabilizer attached is configured to be positioned on the electrical socket, with the tension clips tightly hugging the sides of the socket. The lamp support on which LED lights are mounted is positioned within the channel located in the columnar support. The stabilizer never enters the inside of the electrical HO socket, nor is there an electrical connection, The present invention not only stabilizes the existing lamp support on which the LEDs are mounted, but also just requires a single end cap locked into place at the opposite end of the lamp support. The stabilizer serves to prevent external conditions, either man made or natural, from allowing any rotation or displacement of the lamp support and therefore the LED lighting.

The novel features which are considered as characteristic of the invention are set forth in particular in the appended claims. The invention, itself, however, both as to its design, construction and use, together with additional features and advantages thereof, are best understood upon review of the following detailed description With reference to the accompanying drawings.

DETAILED DESCRIPTION OF THE INVENTION

Figure 1:
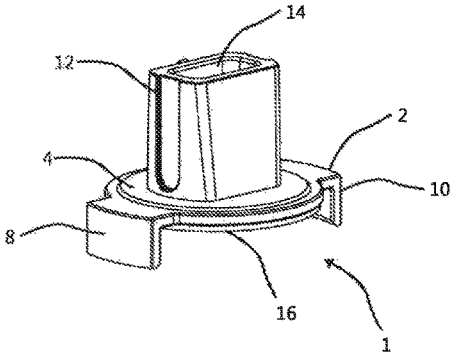
FIG. 1 is a perspective view of the lamp support stabilizer of the present invention.
Figure 2:
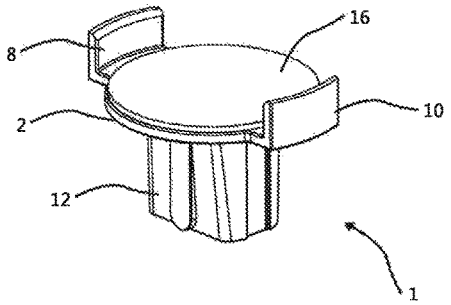
FIG. 2 is a bottom perspective view of the lamp support stabilizer of the present invention.
Figure 3:
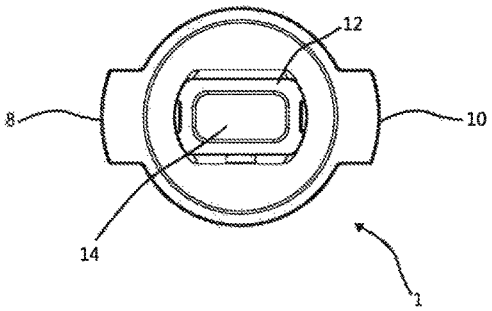
FIG. 3 is a top view of the lamp support stabilizer of the present invention.
Figure 4:
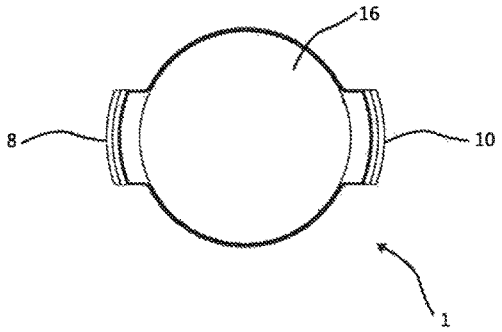
FIG. 4 is a bottom view of the lamp support stabilizer of the present invention.
Figure 5:
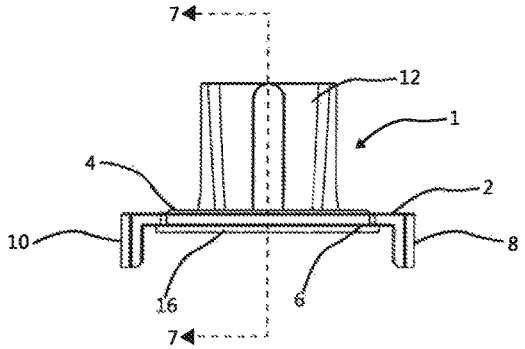
FIG. 5 is a front elevation view of the lamp support stabilizer of the present invention.
Figure 6:
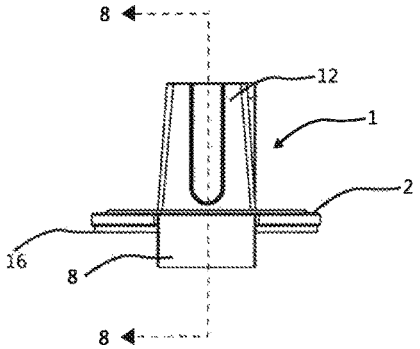
FIG. 6 is an elevation view of the lamp support stabilizer of the present invention.
Figure 7:
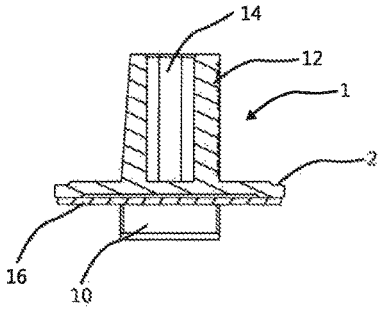
FIG. 7 is a cross-sectional view taken from FIG. 5.
Figure 8:
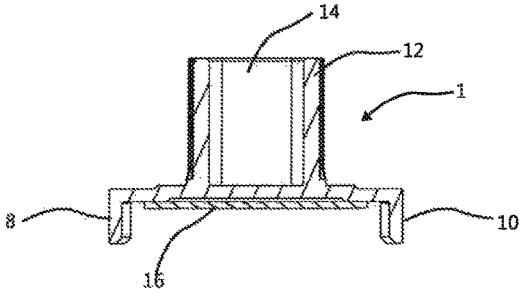
FIG. 8 is a cross-sectional view taken from FIG. 6.
Figure 10:
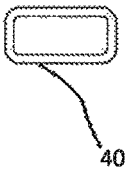
FIG. 10 is an end view of the lamp support shown in FIG. 9.
Figure 9:
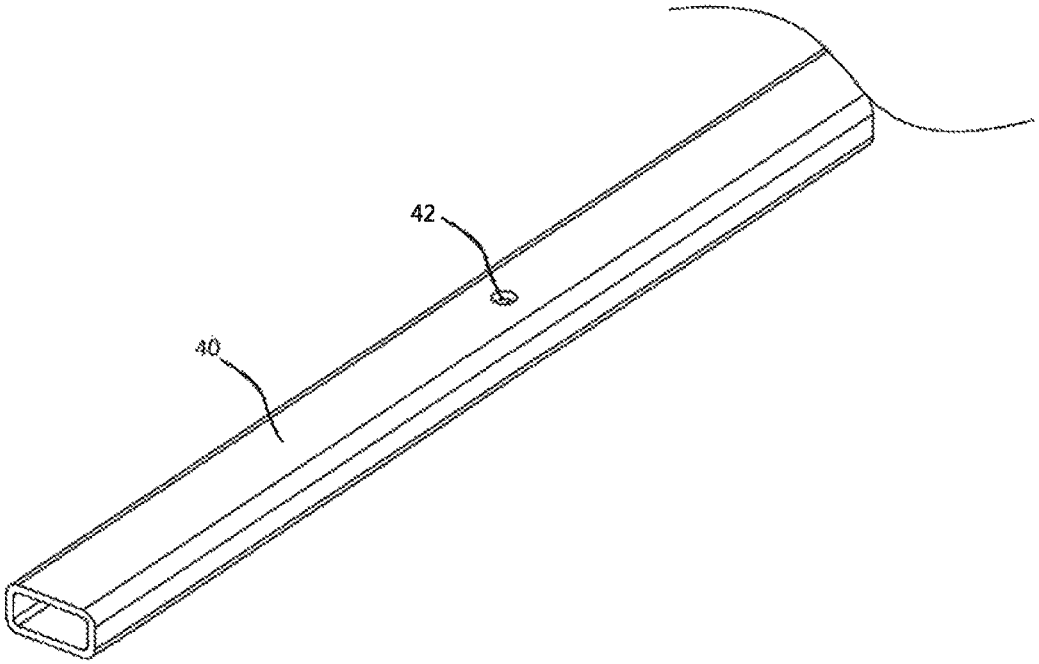
FIG. 9 is a perspective view of a lamp support to be used with the stabilizer of the present invention.
Figure 11:
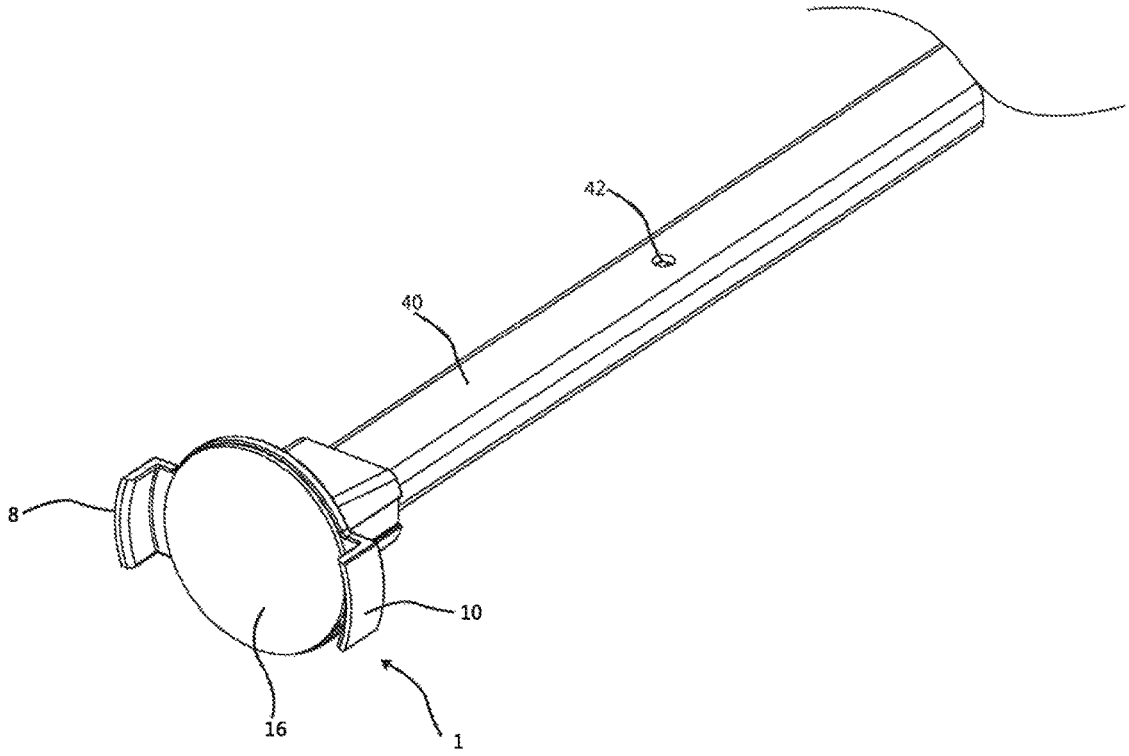
FIG. 11 is a bottom perspective view of the lamp support stabilizer of the present invention mounted on a lamp support.

Lamp support stabilizer 1 of the present invention is an integral body comprising circular shaped plate base member 2 having top surface 4 and bottom surface 6. Dual lateral locking clip members 8 and 10 extend downwardly from opposite sides of base member 2 and rectangular shaped columnar support member 12 extends upwardly from top surface 4 of the base member. Support member 12 has through channel 14.

Figure 12:
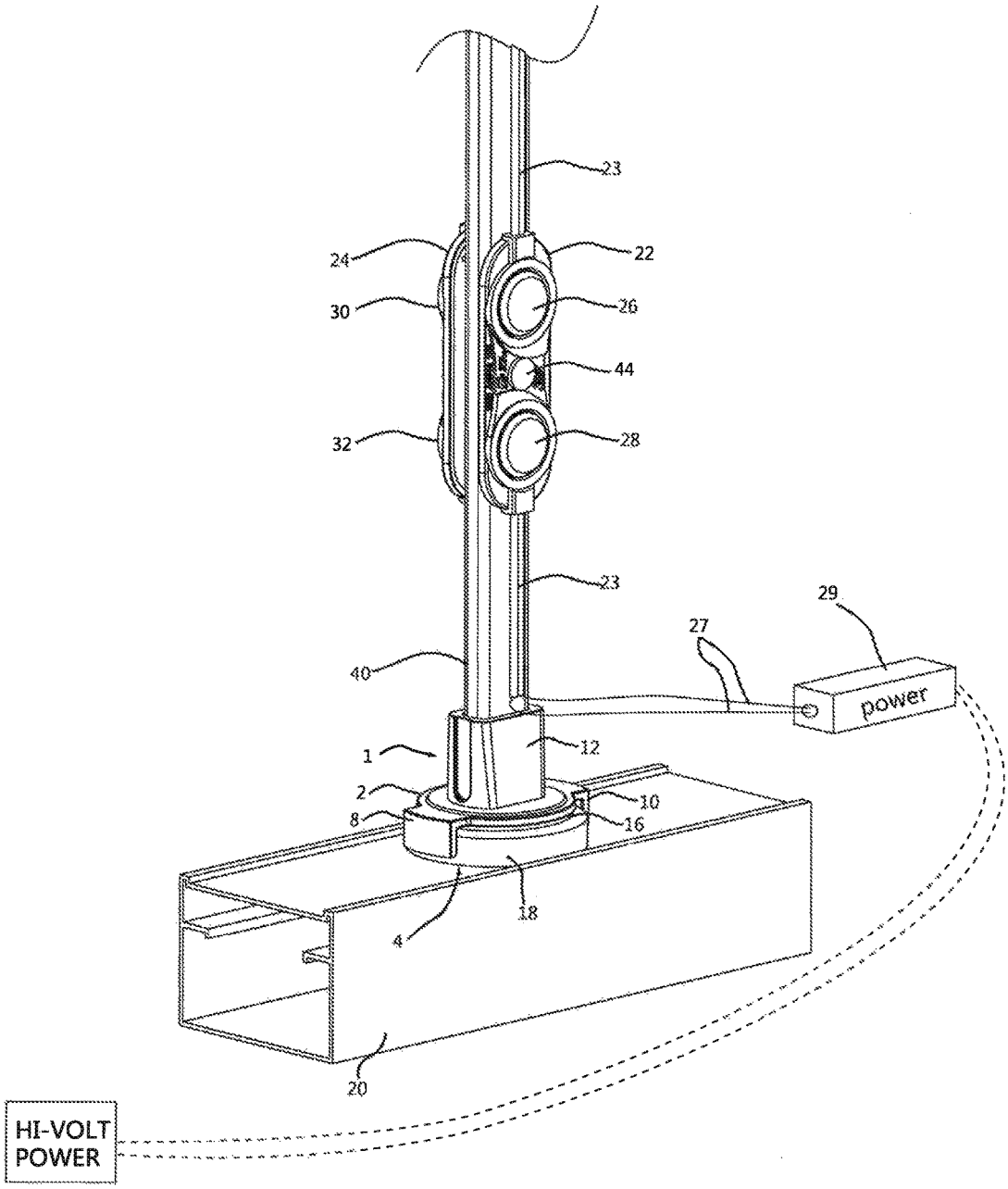
FIG. 12 illustrates the use of the lamp support used in accordance with the stabilizer of the present invention.
Figure 14:
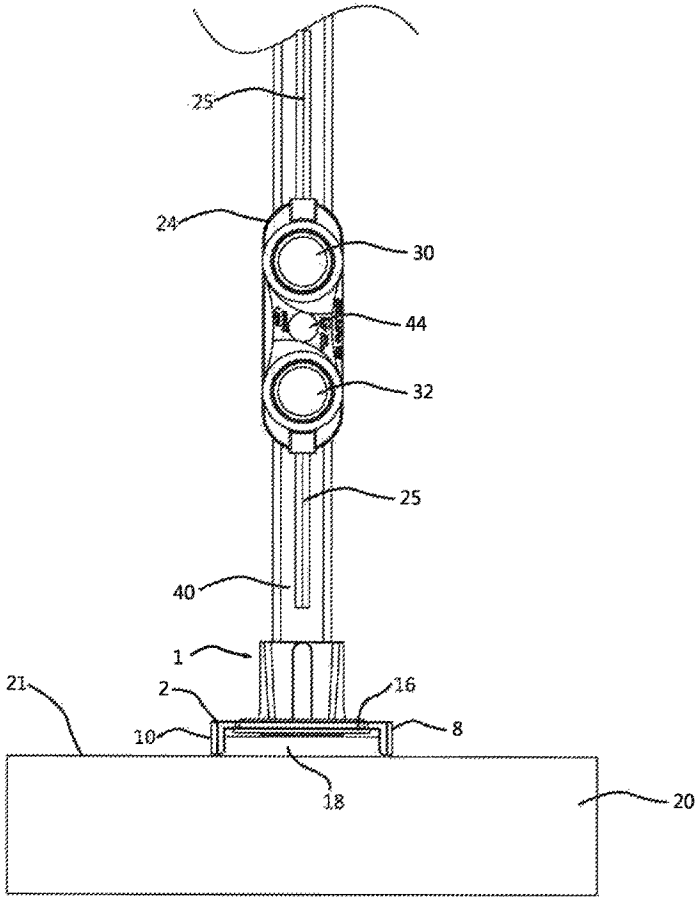
FIG. 14 is a front view of FIG. 12.
Figure 13:
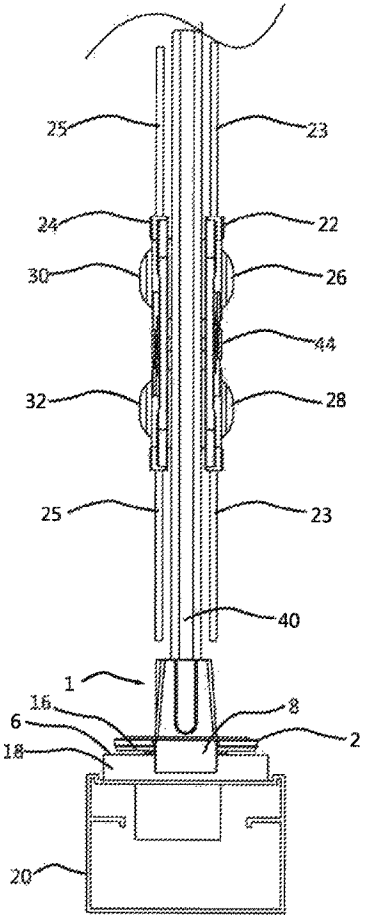
FIG. 13 is an elevation view of FIG. 12.

Adhesive member 16 is designed to be attached to bottom surface 6 of stabilizer 1. Stabilizer 1 is then in turn positioned on and secured by adhesive member 16 to electrical HO socket 18, with its clip members 8 and 10 located along the sides of and tightly hugging the electrical socket, as best seen in FIGS. 12-14. For purposes of illustration electrical socket 18 is mounted on sign frame extrusion 20.

LED light modules 22 and 24, having LED lamps 26, 28, 30, acid 32, are mounted on lamp support 40 by means of fixed pin 44 through opening 42 in the lamp support. The bottom end of lamp support 40 is vertically positioned within channel 14 of support member 12. Electrical wiring 27 is located within electrical wire housings 23 and 25, which extend into power source 29.

In this manner, stabilizer 1 immovably supports and maintains lamp support 40 on frame support 20, as shown in FIG. 12. This serves to retain LED modules 22 and 24 and their LED lamps 26, 28, 30, and 32, in fixed positions, regardless of outside forces. Stabilizer 1 stabilizes lamp support 40 and only requires a single end cap to be locked into place at the opposite end of the lamp support.

Lamp support stabilizer 1 of the present invention offers a simple yet effective means of providing a secure, immovable, and stable connection between lamp support 40 and electrical socket 18. It allows the lamp support to be positioned vertically or in any angular position, by use of a single economically manufactured component.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A stabilizer for maintaining a secure connection between a lamp support and an electrical socket, said stabilizer comprising:

an integral, unitary stabilizer body having:

a plate-shaped base member comprising bottom and top surfaces;

dual lateral locking clip members extending downwardly from opposite sides of the base member; and a columnar support member extending upwardly from the top surface of the base member, said columnar support member having a through channel sized to accept a lamp support;

wherein the base member of the stabilizer body is configured to be positioned on an electrical socket with the locking clip members of the stabilizer body tightly hugging sides of the electrical socket and wherein a lamp support is positioned within the channel of the columnar support member, thereby providing a secure, immovable and stable connection between the lamp support and the electrical socket.

2. The stabilizer as in claim 1 wherein an adhesive member is secured to the bottom surface of the base member of the stabilizer body.

3. The stabilizer as in claim 1 wherein the plate-shaped member is circular in configuration.

4. The stabilizer as in claim 1 wherein the support member is rectangular in configuration.

5. A system for maintaining a secure connection between a lamp support and an electrical socket, said system comprising:

a stabilizer having an integral, unitary body, said stabilizer comprising a plate-shaped base member having bottom and top surfaces, dual lateral locking clip members extending downwardly from opposite sides of the base member, and a columnar support member extending upwardly from the top surface of the base member, said columnar support member having a through channel sized to accept a lamp support;

an adhesive member attached to the bottom surface of the base member of the stabilizer;

an electrical socket; and a lamp support positioned within the channel of the columnar support member of the stabilizer, whereby the stabilizer is positioned on and secured by means of the adhesive member to the electrical socket with the locking clip members of the stabilizer tightly hugging sides of the electrical socket, thereby providing a secure, immovable and stable connection between the lamp support and the electrical socket.

6. The stabilizer as in claim 5 wherein the plate-shaped member is circular in configuration.

7. The stabilizer as in claim 5 wherein the support member is rectangular in configuration.

* * * * *